US005565177A

United States Patent [19]

Cetinkaya

[11] Patent Number: 5,565,177

[45] Date of Patent: Oct. 15, 1996

[54] SIDE MOUNTED FCC STRIPPER WITH TWO-ZONE STRIPPING

[75] Inventor: Ismail B. Cetinkaya, Palatine, Ill.

[73] Assignee: UOP, Des Plaines, Ill.

[21] Appl. No.: 574,174

[22] Filed: Dec. 18, 1995

Related U.S. Application Data

[60] Division of Ser. No. 837,133, Feb. 19, 1992, Pat. No. 5,474,669, which is a continuation-in-part of Ser. No. 696, 384, May 6, 1991, abandoned, which is a continuation-in-part of Ser. No. 285,694, Dec. 16, 1988, abandoned.

[51] Int. Cl.[6] ..... F27B 15/08; C10G 11/18

[52] U.S. Cl. ..... 422/144; 422/145; 422/147; 208/151; 208/161; 208/103

[58] Field of Search ..... 422/144, 145, 422/147; 208/151, 113, 161

[56] References Cited

U.S. PATENT DOCUMENTS

| | | | |
|---|---|---|---|
| 2,440,620 | 4/1948 | Taff | 23/288 |
| 2,541,801 | 2/1951 | Wilcox | 196/52 |
| 2,612,438 | 9/1952 | Murphree | 23/288 |
| 2,838,382 | 6/1958 | Ringgenberg | 23/288 |
| 2,994,659 | 8/1961 | Slyngated et al. | 208/113 |
| 3,893,812 | 7/1975 | Conner et al. | 200/165 |
| 3,894,932 | 7/1975 | Owen | 208/74 |
| 4,364,905 | 12/1982 | Fahrig et al. | 422/144 |
| 4,414,100 | 11/1983 | Krug et al. | 208/153 |
| 4,481,103 | 11/1984 | Krumbeck et al. | 208/120 |
| 4,500,423 | 2/1985 | Krug et al. | 208/161 |
| 4,572,780 | 2/1986 | Owen et al. | 200/161 |
| 4,605,491 | 8/1986 | Haddad et al. | 200/164 |
| 4,738,829 | 4/1988 | Krug | 208/151 |
| 4,917,790 | 4/1990 | Owen | 200/164 |
| 4,921,596 | 5/1990 | Chou | 200/164 |
| 5,032,252 | 7/1991 | Owen et al. | 200/164 |
| 5,043,055 | 8/1991 | Owen et al. | 200/164 |
| 5,059,305 | 10/1991 | Sapre | 200/164 |
| 5,112,576 | 5/1992 | Kruse | 200/164 |
| 5,141,625 | 8/1992 | Lomas | 200/161 |
| 5,158,669 | 10/1992 | Cetinkaya | 208/113 |
| 5,474,669 | 12/1995 | Cetinkaya | 208/151 |

*Primary Examiner*—Virginia Manoharan
*Assistant Examiner*—N. Bhat
*Attorney, Agent, or Firm*—Thomas K. McBride; John G. Tolomei

[57] ABSTRACT

A side-by-side reactor vessel and stripping vessel arrangement uses a rejection vessel to collect the catalyst from the bottom of a reactor vessel and eliminate stagnant layers of catalyst within the reactor vessel while increasing the efficiency of a stripper vessel located to the side of the reactor. Catalyst containing entrained and sorbed hydrocarbons pass from the bottom of a reactor vessel into the small diameter rejection vessel that provides a hydrocarbon rejection zone and uses a fresh stripping medium to maintain a dense fluidized bed from which entrained hydrocarbons are quickly disengaged from the catalyst and travel upward into the reactor vessel. Partially stripped catalyst flows through a passageway that extends horizontally to a stripping vessel that contains a conventional stripping zone. In the stripping vessel, catalyst counter-currently contacts additional stripping medium which removes sorbed hydrocarbons from the catalyst surface. Stripped catalyst is transferred from the stripper vessel to a regeneration zone and stripping gas is returned by the horizontally extending passageway to an upper section of the rejection zone where it recontacts incoming catalyst before passing upwardly into the reactor vessel. In addition to eliminating the stagnant layer of catalyst often associated with a side-by-side reactor and stripper arrangement, the invention also provides additional effective reactor length to accommodate longer cyclones and increases the efficiency of the stripping operation by providing quick disengagement of readily stripped hydrocarbons and additional contacting between the catalyst and stripping gas.

11 Claims, 2 Drawing Sheets

SIDE MOUNTED FCC STRIPPER WITH TWO-ZONE STRIPPING

CROSS-REFERENCE TO RELATED APPLICATIONS

This application is a division of U.S. application Ser. No. 07/837,133, filed Feb. 19, 1992, now issued as U.S. Pat. No. 5,474,669 which is a continuation-in-part of U.S. application Ser. No. 696,384, filed May 6, 1991, now abandoned and which is a continuation-in-part of U.S. application Ser. No. 285,694, filed Dec. 16, 1988, now abandoned.

BACKGROUND OF THE INVENTION

1. Field of the Invention

This invention relates to the fluidized catalytic cracking (FCC) conversion of heavy hydrocarbons into lighter hydrocarbons with a fluidized stream of catalyst particles. More specifically, this invention relates to the process and apparatus for stripping catalyst from the FCC reaction process.

2. Description of the Prior Art

Catalytic cracking is accomplished by contacting hydrocarbons in a reaction zone with a catalyst composed of finely divided particulate material. The reaction in catalytic cracking, as opposed to hydrocracking, is carried out in the absence of added hydrogen or the consumption of hydrogen. As the cracking reaction proceeds, substantial amounts of coke are deposited on the catalyst. A high temperature regeneration within a regeneration zone operation burns coke from the catalyst. Coke-containing catalyst, referred to herein as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones, and combusting coke in the regenerator are well known by those skilled in the art of FCC processes. To this end, the art is replete with vessel configurations for contacting catalyst particles with feed and regeneration gas, respectively.

A majority of the hydrocarbon vapors that contact the catalyst in the reaction zone are separated from the solid particles by ballistic and/or centrifugal separation methods within the reaction zone. However, the catalyst particles employed in an FCC process have a large surface area, which is due to a great multitude of pores located in the particles. As a result, the catalytic materials retain hydrocarbons within their pores and upon the external surface of the catalyst. Although the quantity of hydrocarbons retained on each individual catalyst particle is very small, the large amount of catalyst and the high catalyst circulation rate which is typically used in a modern FCC process results in a significant quantity of hydrocarbons being withdrawn from the reaction zone with the catalyst.

Therefore, it is common practice to remove, or strip, hydrocarbons from spent catalyst prior to passing it into the regeneration zone. It is important to remove retained spent hydrocarbons from the spent catalyst for process and economic reasons. First, hydrocarbons that entered the regenerator increase its carbon-burning load and can result in excessive regenerator temperatures. Stripping hydrocarbons from the catalyst also allows recovery of the hydrocarbons as products. Avoiding the unnecessary burning of hydrocarbons is especially important during the processing of heavy (relatively high molecular weight) feedstocks, since processing these feedstocks increases the deposition of coke on the catalyst during the reaction (in comparison to the coking rate with light feedstocks) and raises the combustion load in the regeneration zone. Higher combustion loads lead to higher temperatures which at some point may damage the catalyst or exceed the metallurgical design limits of the regeneration apparatus.

The most common method of stripping the catalyst passes a stripping gas, usually steam, through a flowing stream of catalyst, countercurrent to its direction of flow. Such steam stripping operations, with varying degrees of efficiency, remove the hydrocarbon vapors which are entrained with the catalyst and hydrocarbons which are adsorbed on the catalyst. Contact of the catalyst with a stripping medium may be accomplished in a simple open vessel as demonstrated by U.S. Pat. No. 4,481,103.

The efficiency of catalyst stripping is increased by using vertically spaced baffles to cascade the catalyst from side to side as it moves down a stripping apparatus and countercurrently contacts a stripping medium. Moving the catalyst horizontally increases contact between the catalyst and the stripping medium so that more hydrocarbons are removed from the catalyst. In these arrangements, the catalyst is given a labyrinthine path through a series of baffles located at different levels. Catalyst and gas contact is increased by this arrangement that leaves no open vertical path of significant cross-section through the stripping apparatus. Further examples of these stripping devices for FCC units are shown in U.S. Pat. Nos. 2,440,620; 2,612,438; 3,894,932; 4,414,100; and 4,364,905. These references show the typical stripper arrangement having a stripper vessel, a series of baffles in the form of frustoconical sections that direct the catalyst inwardly onto a baffle in a series of centrally located conical or frusto conical baffles that divert the catalyst outwardly onto the outer baffles. The stripping medium enters from below the lower baffle in the series and continues rising upward from the bottom of one baffle to the bottom of the next succeeding baffle. Variations in the baffles include the addition of skirts about the trailing edge of the baffle as depicted in U.S. Pat. No. 2,994,659 and the use of multiple linear baffle sections at different baffle levels as demonstrated in FIG. 3 of U.S. Pat. No. 4,500,423. A variation in introducing the stripping medium is shown in U.S. Pat. No. 2,541,801 where a quantity of fluidizing gas is admitted at a number of discrete locations.

The use of a stripping vessel subadjacent to a reactor vessel in combination with a separate larger stripper vessel is known from U.S. Pat. No. 4,481,103.

The use of a small stripping vessel within a reactor vessel is known from U.S. Pat. No. 2,838,382.

In order to achieve good stripping of the catalyst and the increased product yield and enhanced regenerator operation associated therewith, relatively large amounts of stripping medium have been required. For the most common stripping medium, steam, the average requirement throughout the industry is well above 1.5 kg of steam per 1000 kg of catalyst for thorough catalyst stripping. The costs associated with this addition of stripping medium are significant. In the case of steam, the costs include capital expenses and utility expenses associated with supplying the steam and removing the resulting water via downstream separation facilities. Any reduction in the amount of steam required to achieve good catalyst stripping will yield substantial economic benefits to the FCC process. As a result, it is an objective of any new stripping design to minimize the addition of stripping medium while maintaining the benefits of good catalyst stripping throughout the FCC process unit.

Process configurations for FCC units have undergone considerable change since the introduction of such process units in the1940's. One well known configuration of FCC unit that gained wide acceptance during the 1950's and 1960's is a stacked FCC reactor and regenerator. This design comprises a reactor vessel stacked one on top of a regenerator vessel. Regenerated catalyst flows from the regeneration vessel through a regenerator standpipe into a riser where it contacts an FCC charge stock. Expanding gases from the charge stock and fluidizing medium convey the catalyst up an external riser and into the reactor vessel. Cyclone separators in the reactor divide the catalyst from reacted feed vapors which pass into an upper recovery line while the catalyst collects in the bottom of the reactor. A stripping vessel, supported from the side of the reactor vessel, receives spent catalyst from the reaction zone. Steam rises from the bottom of the stripper, countercurrent to the downward flow of catalyst, and removes sorbed hydrocarbons from the catalyst. Spent catalyst continues its downward movement from the stripper vessel through a reactor standpipe and into a dense fluidized catalyst bed contained within the regeneration vessel. Coke on the spent catalyst reacts with oxygen in an air stream that ascends through the regeneration vessel and ultimately becomes regeneration gas. Again, cyclone separators at the top of the regenerator return catalyst particles to the dense bed and deliver a relatively catalyst-free regeneration gas to an overhead gas conduit.

Changes in the FCC equipment and the operation of FCC units have decreased the utility of older FCC reactors especially stacked reactor regenerator designs. Two such changes include the adoption of all riser cracking in FCC units and the use of higher efficiency cyclones. In early FCC processes, after initial contact with the catalyst and oil in a relatively small diameter riser conduit, reaction of the catalyst and oil feed continued in a dense bed contained within the reactor vessel. Modern FCC units have extended the reactor riser and eliminated the dense bed in the reaction zone so that the majority of any cracking reactions occur in the riser conduit. The use of cyclones to centrifically separate gases from catalyst particles is the principal method for separating catalyst and hydrocarbons in the FCC reactor. In an effort to decrease particulate emissions from FCC units, higher efficiencies are sought from the cyclones. Higher efficiencies generally require a longer cyclone length in order to allow a longer vortex formation within the cyclone and obtain a more complete separation of the catalyst particles from the gases.

Both all riser cracking and the use of more efficient cyclones having longer lengths pose special problems for reactors having short tangent lengths and especially stacked FCC reactors having side strippers mounted thereon. In order to fit the longer cyclones within the reactor vessel, a greater length is needed than is sometimes provided in older reactor vessels. The addition of riser cracking has compounded the problem in some cases by the elimination of the dense bed of fluidized catalyst. In order to function properly, the lower outlet or discharge leg of the cyclone must empty into or above a fluidized bed of catalyst. Before all riser cracking all of the gases and catalyst from the riser entered the lower portion of the reactor to fluidize all of the catalyst in the lower portion of the reactor vessel. Thus, a dense fluidized bed was maintained through the entire lower portion of the reactor. All riser cracking adds the catalyst and gases at an upper elevation of the reactor vessel so that catalyst, located below the point where catalyst is withdrawn from the reactor, forms a stagnant bed. Where this catalyst withdrawal point is located at a relatively high location on the vessel shell, it significantly raises the lowermost point at which the cyclone discharge legs can be located, thereby limiting the total length available for the cyclones.

In the case of stacked FCC units having side mounted strippers, the catalyst withdrawal point is on the side of the reactor vessel some distance up from the bottom of the reactor. Conversion of these units to all riser cracking and the elimination of the dense fluidized bed thereby formed a stagnant layer of catalyst that sloped upward from the stripper outlet to the opposite side of the reactor vessel. This upwardly sloping layer of stagnant catalyst severely restricted the internal length of the reactor vessel that was available for the reactor cyclones. One solution to the length restrictions imposed by the stagnant layer of catalyst is to convert the stagnant layer of catalyst to a fluidized bed by the addition of a fluidizing medium to the bottom of the reactor vessel. However, this is not practical due to the large size of the reactor vessel and the volume of fluidizing medium required for fluidization. In addition, there's a limited amount of clearance available between the bottom of the reactor and the top of the regenerator which prevents the use of a typical stripper outlet for the withdrawal of catalyst from the bottom of the reactor.

In view of the large number of older style FCC units that are still in existence, it would be highly useful to have a method and arrangement for stripping FCC catalyst that would overcome the problems associated with all riser cracking and the use of more efficient cyclones.

More recently efforts to improve all riser cracking operation seek to reduce the post riser residence time of reactants. Reductions in post riser residence time apply to overall residence time in the reactor and stripping vessel and post riser contact time of hydrocarbons with catalyst. Post riser residence time reductions improve product yields and selectivity. Conventional stripping arrangements operate with a high downward superficial catalyst flux that increase the contact time of entrained hydrocarbons with the catalyst. It would also be useful to have a stripping arrangement that reduces the post riser residence time and catalyst contact time.

BRIEF SUMMARY OF THE INVENTION

Accordingly, it is one object of this invention to provide a more efficient method of stripping sorbed hydrocarbons from FCC catalyst in a side-by-side reactor and stripper arrangement.

It is a further object of this invention to obtain a method and apparatus that provides a more complete utilization of stripping medium.

A further object of this invention is to provide a stripping arrangement that reduces the post-riser residence time and hydrocarbon contact time of hydrocarbons.

Another object of this invention is to provide a highly efficient stripper arrangement that is particularly suited for a stacked FCC unit.

A yet further object of this invention is to increase the available height for cyclone installation in the reactor vessel of a stacked FCC unit having all riser cracking.

These and other objects are achieved by the method of this invention which uses a rejection zone in the form of a small diameter vessel at the bottom of an FCC reactor to receive a principally vertical flow of catalyst from a reactor vessel. Stripping medium added to the bottom of the rejection zone creates a dense fluidized bed within the rejection zone which forms a highly effective stage of hydrocarbon rejection for separating entrained hydrocarbons from the catalyst. The rejection zone operates with an upper section that contacts the catalyst with stripping gas containing hydrocarbons and a lower section that contacts the catalyst with fresh stripping gas. Catalyst from the lower section of the rejection zone carries little entrained hydrocarbons and passes to a vertically oriented stripping zone that removes sorbed hydrocarbons and contains a series of baffles over which the catalyst flows downwardly as it countercurrently contacts a stripping medium that flows upwardly from the bottom of the stripping zone. Stripping medium from the stripping zone that contains hydrocarbons passes the upper section of the rejection zone to increase the effectiveness of the initial hydrocarbon rejection.

In one embodiment, this invention is a process for stripping hydrocarbons from spent FCC catalyst. This process transfers a mixture of catalyst and hydrocarbon containing gas to an FCC reactor vessel and at least partially separates gas from the catalyst in the vessel and directs a first catalyst stream containing entrained and sorbed hydrocarbons downwardly from the reactor vessel into a hydrocarbon rejection zone. The hydrocarbon rejection zone contacts the first catalyst stream in an upper section of the hydrocarbon rejection zone with a combined stripping gas and disengages entrained hydrocarbons from the first hydrocarbon stream. The process passes a second catalyst stream containing a reduced amount of entrained hydrocarbons relative to the first catalyst stream to a lower section of the hydrocarbon rejection zone and contacts the second catalyst stream with a first stripping gas, consisting essentially of stripping medium, in the lower section of the hydrocarbon rejection zone for a first average residence time to disengage additional entrained hydrocarbons from the second catalyst stream and passes a second stripping gas containing hydrocarbons into the upper section of the hydrocarbon rejection zone. The third stream of catalyst containing a reduced amount of entrained hydrocarbons relative to the second catalyst stream passes from the hydrocarbon rejection zone to a separate stripping zone that contacts the third stream of catalyst with a third stripping gas in the stripping zone for a second average time in excess of the first average residence time to remove sorbed hydrocarbons from the catalyst. The process passes a fourth stripping gas containing hydrocarbons from the top of the stripping zone to the upper section of the rejection zone and combines the fourth stripping gas with the second stripping gas to form the combined stripping gas and recovers stripped catalyst from the stripping zone.

In another embodiment, this invention is a side-by-side reactor vessel and stripping vessel arrangement. The reactor vessel has a vertical orientation and a catalyst inlet for receiving catalyst and hydrocarbon vapors. A rejection vessel located subadjacent to said reactor vessel defines a rejection zone having a catalyst outlet in the sidewall of a lower section of the rejection vessel and a first stripping gas inlet located at or below the catalyst outlet. The arrangement includes means for providing a stripping zone including an elongate stripping vessel laterally offset from and located outside of the reactor vessel having a longer vertical length than the rejection vessel and means for passing stripping gas from the stripping zone to an upper section of the rejection zone and for passing catalyst from the catalyst outlet to the stripping zone. A reactor riser in communication with the reactor vessel discharges catalyst and gas into the reactor vessel.

Additional objects, embodiments and details of this invention are given in the following detailed description of the invention.

DETAILED DESCRIPTION OF THE INVENTION

Figure 1:
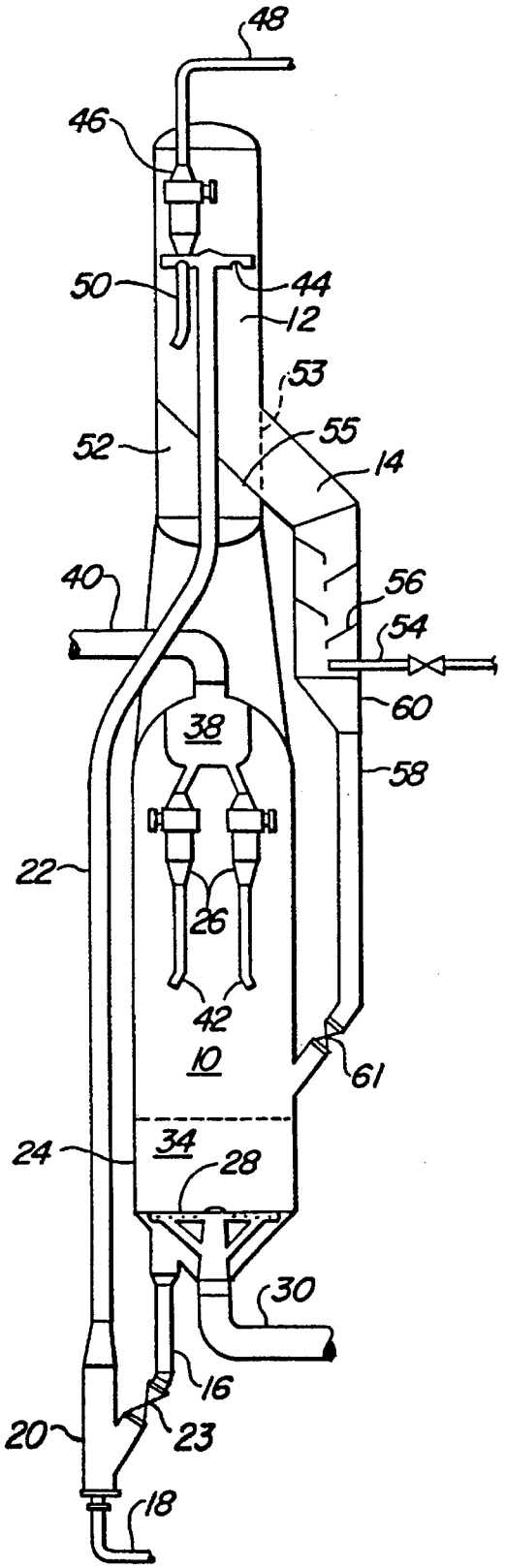
FIG. 1 is representative of the prior art and shows a sectional elevation view of a stacked FCC regenerator-reactor and stripper arrangement.

Looking first at a more complete description of the FCC process, the typical feed to an FCC unit is a gas oil such as a light or vacuum gas oil. Other petroleum-derived feed streams to an FCC unit may comprise a diesel boiling range mixture of hydrocarbons or heavier hydrocarbons such as reduced crude oils. It is preferred that the feed stream consist of a mixture of hydrocarbons having boiling points, as determined by the appropriate ASTM test method, above about 230° C. and more preferably above about 290° C. It is becoming customary to refer to FCC type units which are processing heavier feedstocks, such as atmospheric reduced crudes, as residual crude cracking units, or resid cracking units. The process and apparatus of this invention can be used for either FCC or residual cracking operations. For convenience, the remainder of this specification will only make reference to the FCC process.

An FCC process unit comprises a reaction zone and a catalyst regeneration zone. In the reaction zone, a feed stream is contacted with a finely divided fluidized catalyst maintained at an elevated temperature and at a moderate positive pressure. In this invention, contacting of feed and catalyst takes place primarily in a riser conduit. The riser comprises a principally vertical conduit as the main reaction site, with the effluent of the conduit emptying into a large volume process vessel, which is called the reactor vessel or may be referred to as a separation vessel. The residence time of catalyst and hydrocarbons in the riser needed for substantial completion of the cracking reactions is only a few seconds. The flowing vapor/catalyst stream leaving the riser may pass from the riser to a solids-vapor separation device located within the separation vessel or may enter the separation vessel directly without passing through an intermediate separation apparatus. When no intermediate apparatus is provided, much of the catalyst drops out of the flowing vapor/catalyst stream as the stream leaves the riser and enters the separation vessel. One or more additional solids/vapor separation devices, almost invariably a cyclone separator, is normally located within and at the top of the large separation vessel. The products of the reaction are separated from a portion of catalyst which is still carried by the vapor stream by means of the cyclone or cyclones and the vapor is vented from the cyclone and separation zone. The spent catalyst falls downward to a lower location within the separation vessel. A stripper is usually located near a lower part of the reactor vessel to remove hydrocarbons from the catalyst and comprises a stripper vessel separate from the riser and reactor vessel. Catalyst is transferred to a separate regeneration zone after it passes through the stripping apparatus.

The rate of conversion of the feedstock within the reaction zone is controlled by regulation of the temperature, activity of the catalyst, and quantity of the catalyst (i.e., catalyst/oil ratio) maintained within the reaction zone. The most common method of regulating the temperature in the reaction zone is by regulating the rate of circulation of catalyst from the regeneration zone to the reaction zone, which simultaneously changes the catalyst/oil ratio. That is, if it is desired to increase the conversion rate within the reaction zone, the rate of flow of catalyst from the regeneration zone to the reaction zone is increased. This results in more catalyst being present in the reaction zone for the same volume of oil charged thereto. Since the temperature within the regeneration zone under normal operations is considerably higher than the temperature within the reaction zone, an increase in the rate of circulation of catalyst from the regeneration zone to the reaction zone results in an increase in the reaction zone temperature.

The chemical composition and structure of the feed to an FCC unit will affect the amount of coke deposited upon the catalyst in the reaction zone. Normally, the higher the molecular weight, Conradson carbon, heptane insolubles, and carbon/hydrogen ratio of the feedstock, the higher will be the coke level on the spent catalyst. Also, high levels of combined nitrogen, such as found in shale-derived oils, will increase the coke level on spent catalyst. Processing of heavier feedstocks, such as deasphalted oils or atmospheric bottoms from a crude oil fractionation unit (commonly referred to as reduced crude) results in an increase in some or all of these factors and therefore causes an increase in the coke level on spent catalyst. As used herein, the term "spent catalyst" is intended to indicate catalyst employed in the reaction zone which is being transferred to the regeneration zone for the removal of coke deposits. The term is not intended to be indicative of a total lack of catalytic activity by the catalyst particles. The term "used catalyst" is intended to have the same meaning as the term "spent catalyst".

The reaction zone, which is normally referred to as a "riser" due to the widespread use of a vertical tubular conduit, is maintained at high temperature conditions which generally include a temperature above about 425° C. Preferably, the reaction zone is maintained at cracking conditions which include a temperature of from about 480° C. to about 590° C. and a pressure of from about 65 to 500 kPa (ga) but preferably less than about 275 kPa (ga). The catalyst/oil ratio, based on the weight of catalyst and feed hydrocarbons entering the bottom of the riser, may range up to 20:1 but is preferably between about 4:1 and about 10:1. Hydrogen is not normally added to the riser, although hydrogen addition is known in the art. On occasion, steam may be passed into the riser. The average residence time of catalyst in the riser is preferably less than about 5 seconds. The type of catalyst employed in the process may be chosen from a variety of commercially available catalysts. A catalyst comprising a zeolite base material is preferred, but the older style amorphous catalyst can be used if desired. Further information on the operation of FCC reaction zones may be obtained from U.S. Pat. Nos. 4,541,922 and 4,541,923 and the patents cited above.

In an FCC process, catalyst is continuously circulated from the reaction zone to the regeneration zone and then again to the reaction zone. The catalyst therefore acts as a vehicle for the transfer of heat from zone to zone as well as providing the necessary catalytic activity. Catalyst which is being withdrawn from the regeneration zone is referred to as "regenerated" catalyst. As previously described, the catalyst charged to the regeneration zone is brought into contact with an oxygen-containing gas such as air or oxygen-enriched air under conditions which result in combustion of the coke. This results in an increase in the temperature of the catalyst and the generation of a large amount of hot gas which is removed from the regeneration zone as a gas stream referred to as a flue gas stream. The regeneration zone is normally operated at a temperature of from about 600° C. to about 800° C. Additional information on the operation of FCC reaction and regeneration zones may be obtained from U.S. Pat. Nos. 4,431,749; 4,419,221 (cited above); and U.S. Pat. No. 4,220,623.

The catalyst regeneration zone is preferably operated at a pressure of from about 35 to 500 kPa (ga). The spent catalyst being charged to the regeneration zone may contain from about 0.2 to about 15 wt. % coke. This coke is predominantly comprised of carbon and can contain from about 3 to 15 wt. % hydrogen, as well as sulfur and other elements. The oxidation of coke will produce the common combustion products: carbon dioxide, carbon monoxide, and water. As known to those skilled in the art, the regeneration zone may take several configurations, with regeneration being performed in one or more stages. Further variety is possible due to the fact that regeneration may be accomplished with the fluidized catalyst being present as either a dilute phase or a dense phase within the regeneration zone. The term "dilute phase" is intended to indicate a catalyst/gas mixture having a density of less than 300 kg/m$^3$. In a similar manner, the term "dense phase" is intended to mean that the catalyst/gas mixture has a density equal to or more than 300 kg/m$^3$. Representative dilute phase operating conditions often include a catalyst/gas mixture having a density of about 15 to 150 kg/m$^3$.

Reference is now made to FIG. 1 in order to show the stacked FCC configuration to which the method of this invention may be applied. The stacked FCC arrangement represents only one of many FCC arrangements to which this invention can be applied. Looking then at FIG. 1, a traditional stacked FCC arrangement will have a regeneration vessel 10, a reactor or upper vessel 12, and a stripping or side vessel 14. A regenerated catalyst conduit 16 transfers catalyst from the regenerator through a control valve 23 and into a lower riser conduit 20 where it contacts hydrocarbon feed entering the riser through hydrocarbon feed conduit 18. Conduit 18 may also contain a fluidizing medium such as steam which is added with the feed. Expanding gases from the feed and fluidizing medium convey catalyst up the riser and into internal riser conduit 22. As the catalyst and feed pass up to the riser, the hydrocarbon feed cracks to lower boiling hydrocarbon products.

Riser 22 discharges the catalyst and hydrocarbon mixture through openings 44 to effect an initial separation of catalyst and hydrocarbon vapors. Outside openings 44, a majority of the hydrocarbon vapors continue to move upwardly into the inlet of cyclone separator 46 which effects a near complete removal of catalyst from hydrocarbon vapors. Separated hydrocarbon vapors exit reactor 12 through an overhead conduit 48 while a discharge leg 50 returns separated catalyst to a lower portion of the reactor vessel. Catalyst from riser outlets 44 and discharge leg 50 collects in a lower portion of the reactor forming a bed of catalyst 52. Bed 52 supplies catalyst to stripping vessel 14. Stripping vessel 14 has a single inlet 53 located on one side of the reaction vessel. Catalyst bed 52 is essentially stagnant so that it has upper bed surface 55 that slopes upwardly, at its angle of repose, from about the bottom of inlet 53 to the opposite side of reactor vessel 12. The relatively high level of bed surface 55 restricts the length of discharge leg 50.

Steam enters stripping vessel 14 through a conduit 54 and rises countercurrent to a downward flow of catalyst through the stripping vessel thereby removing sorbed hydrocarbons from the catalyst which flow upwardly through inlet 53 and are ultimately recovered with the steam by cyclone separator 46. In order to facilitate hydrocarbon removal, a series of downwardly sloping baffles 56 are provided in the stripping vessel 14. A spent catalyst conduit 58 removes catalyst from a lower conical section 60 of stripping vessel 14. A control valve 61 regulates the flow of catalyst from conduit 58.

Regeneration gas, such as compressed air, enters regenerator 10 through a conduit 30. An air distributor 28 disperses air over the cross-section of regenerator 10 where it contacts spent catalyst in bed 34. Coke is removed from the catalyst by combustion with oxygen from distributor 28. Combustion by-products and unreacted air components rise upwardly along with entrained catalyst through the regenerator into the inlets of cyclones 26. Relatively catalyst-free gas collects in an internal chamber 38 which communicates with a gas conduit 40 and removing spent regeneration gas from the regenerator. Catalyst, separated by the cyclones, drops from the separators through discharge legs 42 and returns to bed 34.

Figure 2:
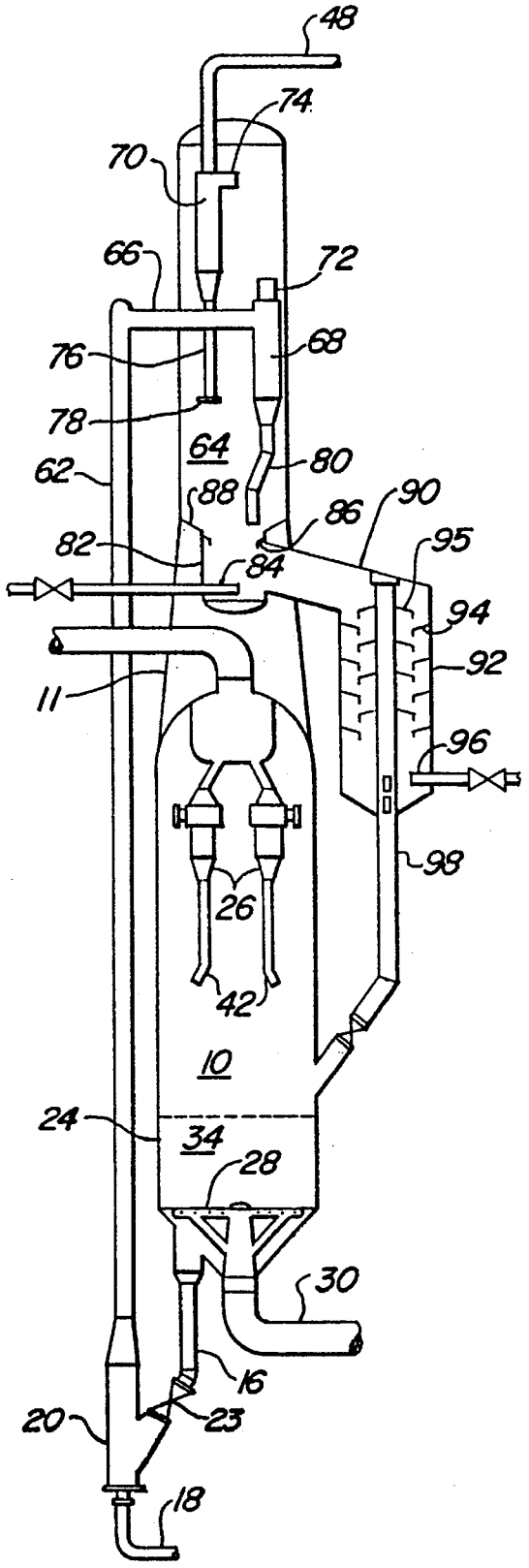
FIG. 2 is a sectional elevation view of a stacked FCC reactor regenerator that incorporates the stripper arrangement of this invention.

A modified form of the stacked reactor regenerator arrangement that incorporates the process of this invention is shown in FIG. 2. Equipment previously described in FIG. 1 that remains unchanged in FIG. 2 maintains the same numbering system.

The regenerator is identical in form to that shown in FIG. 1. The regenerator is also operated in substantially the same manner as that previously described. Thus, the hydrocarbon feed and catalyst are mixed in the lower riser conduit 20 and conveyed upward through a riser 62 which now enters a reactor vessel 64 through a horizontal conduit 66. Inside reactor 64, a high efficiency cyclone system consisting of a first stage cyclone 68 and a second stage cyclone 70, separates the product vapors and catalyst. Conduit 66 passes the mixture of catalyst and hydrocarbons directly into the first stage cyclone 68. The initial separation in cyclone 68 separates the majority of the catalyst from the hydrocarbon stream. The separated hydrocarbon stream which now contains a relatively small amount of catalyst particles is discharged from the top of cyclone 68 through an outlet tube 72. An inlet duct 74 receives catalyst and gases that enter secondary cyclone 70. Cyclone 70 performs a final separation and provides a gaseous stream containing product hydrocarbons which is essentially free of catalyst particles. The product stream is taken overhead by line 48 to additional separation facilities for the recovery of products. The small amount of catalyst recovered by cyclone 70 passes downwardly through a discharge leg 76 and out into the reactor vessel through a flapper valve 78. Catalyst from discharge leg 76 collects at the bottom of reactor vessel 64 with catalyst from primary cyclone 68 which leaves the cyclone via discharge leg 80. Discharge leg 80 is extended into a hydrocarbon rejection zone 82 in order to maximize the available overall length and to seal the outlet of discharge leg 80 in the fluidized dense catalyst.

The bottom of reactor 64 opens into a subadjacent hydrocarbon rejection zone 82. The hydrocarbon rejection zone is located directly above the regeneration vessel 10 and within a frusto-conical skirt 11 that supports the reaction vessel from the regeneration vessel. Catalyst from the bottom of reactor 64 falls into the an upper section of the hydrocarbon rejection zone 82 where it is contacted with a stripping medium that enters the bottom of the hydrocarbon rejection zone through a distributor 84 and stripping medium that flows into the upper section of the hydrocarbons rejection zone from a hereinafter described stripping zone such that the stripping medium that contact the catalyst as it first enters the upper section of the rejection zone is a combined stripping gas stream. By using the combined stripping gas stream all of the stripping gas from the stripping and hydrocarbon rejection initially contacts the catalyst to initiate rapid disengagement of entrained hydrocarbons.

Stripping medium refers to the fluid that is added to the stripping vessel or the hydrocarbon rejection zone and used to desorb hydrocarbons from the surface of the catalyst. The most common stripping medium is steam. Stripping gas refers to either the stripping medium or a mixture of stripping medium, desorbed hydrocarbons and other gases or vapors that may be present in the stripper or rejection vessel.

Stripping medium first enters hydrocarbon rejection zone 82 in an amount that will maintain a dense fluidized bed of catalyst in the lower section of the rejection zone and serve to further disengage entrained hydrocarbons and remove easily strippable hydrocarbons from the surface of the catalyst. In order to provide the dense fluidized bed, stripping medium will ordinarily be added to the hydrocarbon rejection zone in a quantity sufficient to produce a superficial velocity of from 0.02 to 1.0 m/sec within the hydrocarbon rejection zone. Preferably the superficial velocity in the hydrocarbon rejection zone will be in a range of from 0.05 to 0.3 m/sec. The bed of hydrocarbon rejection zone 82 will preferably have a density of from 900 $kg/m^3$ to 450 $kg/m^3$. Relatively short catalyst residence times are also employed in the hydrocarbon rejection zone and range from 3 to 20 seconds.

Fresh stripping gas, i.e., stripping gas consisting essentially of stripping medium or steam contacts the catalyst in the lower section of the rejection zone. The fresh stripping gas increases the stripping medium concentration in the lower section of the rejection zone and further enhances the disengagement of entrained hydrocarbons and the recovery of easily strippable hydrocarbons. Stripping gas that contains hydrocarbons passes upwardly out of the lower section of the rejection zone. Catalyst that has at least the majority of entrained hydrocarbons removed passes from the lower section of the rejection zone to an additional stripping zone.

The geometry of the rejection zone contributes to the efficiency and rapid rejection of hydrocarbons from rejection and stripping zones. Preferably, the hydrocarbon rejection zone has a diameter that is less than the diameter of the reactor. In its most preferred form, the diameter of the hydrocarbon rejection zone is less than half the diameter of the reactor. A small diameter in the hydrocarbon rejection vessel permits the dense fluidized bed in hydrocarbon rejection zone 82 to be maintained with only a fraction of the stripping medium that would be necessary to maintain dense fluidized bed conditions across the entire diameter of the larger reactor vessel. Therefore, the hydrocarbon rejection zone has eliminated the larger layer of stagnant catalyst that is usually associated with the typical stacked reactor that uses all riser cracking with only a small addition of fluidizing medium. In addition, the elimination of the dense stagnant bed provides the additional length necessary for the use of primary cyclone 68 having the discharge leg 80.

Efficient use of stripping gas is enhanced by the baffle 86 which surrounds the inlet the upper section of hydrocarbon rejection zone 82. The downwardly sloped surface of baffle 86 forms a pocket that traps stripping gas entering the upper section of the rejection zone from a stripping zone. In one embodiment a passageway 90 carries the stripping gas which passes out of the pocket and into contact with catalyst entering the hydrocarbon rejection zone along the sloped surfaces 86 of the baffle and 88 of the reactor bottom. The recovery of stripping gas from the stripping zone reduces the amount of fresh stripping medium or steam that is added to the hydrocarbon rejection zone. Typically, the ratio of stripping medium or steam to catalyst in the hydrocarbon rejection zone will typically range from 0.1/1,000 to 0.5/1,000.

The geometry of hydrocarbon rejection zone 82 also facilitates the recovery of stripping gas by providing a region where there is a high superficial horizontal flux of catalyst out of the rejection zone at a location that is near the catalyst entrance of the rejection zone. Most conventional strippers have a long length, which creates a high superficial vertical flux of catalyst, and an outlet at the bottom of the stripper which provides a high superficial flux of catalyst in the horizontal direction. The high superficial flux of catalyst in the horizontal direction serves to reduce the reentrainment of stripped vapors by decreasing the length of superficial vertical catalyst flux that entrains hydrocarbons with the downwardly flowing catalyst. Therefore, hydrocarbon rejection zone 82 has a vertical length that is less than the diameter of reactor vessel 64 and eliminate any region of prolonged superficial vertical catalyst flux that would suppress disengagement of entrained hydrocarbons.

The hydrocarbon rejection zone has a catalyst outlet in the sidewall of the rejection vessel that withdraws catalyst. Location of the opening in the sidewall creates superficial horizontal catalyst flux. The opening communicates catalyst from the lower section of the hydrocarbon rejection zone. Preferably the opening will take catalyst from an upper portion of the lower rejection zone section. In one embodiment the catalyst outlet communicates with passageway 90. Passageway 90 withdraws partially stripped catalyst from the side of hydrocarbon rejection zone 82 and passes stripping gas from the stripping zone to the upper section of the rejection zone. The opening for passageway 90 occupies an upper portion of the lower rejection section. Passageway 90 slopes downward and also extends horizontally outward away from rejection vessel 82. Passageway 90 has a much larger diameter than other conduits that are typically used to transfer catalyst between zones. In preferred form the diameter of the passageway 90 will approach the diameter of the rejection vessel 82 to allow disengagement of stripping gas from the catalyst within the passageway. For this purpose the passageway will have a diameter of at least two feet and that is at least equal to one quarter the vertical sidewall length of rejection vessel 82 and more preferably at least one half of the vertical length of vertical vessel 82. As catalyst from the hydrocarbon rejection zone passes through passageway 90, its large diameter causes catalyst to travel along a lower surface of the passageway where vertical disengagement of the stripping gas medium from the catalyst can occur. Vertical disengagement of stripping gas from the catalyst is also influenced by the angle of the passageway. In order to promote vertical disengagement, passageway 90 should extend from subadjacent vessel 82 at an angle that does not exceed 45° from horizontal.

A stripper vessel 92, at the end of passageway 90, provides a stripping zone and receives the partially stripped catalyst. Stripper vessel 92 has a length that is longer than the vertical length of the hydrocarbon rejection zone 82. Stripper 92 uses a series of baffles 94 to contact the incoming catalyst with additional stripping medium. These baffles may be of any geometric form. Instead of baffles that alternately extend halfway across the diameter of the stripper vessel as shown by number 56 in FIG. 1, stripper vessel 92 uses outer baffles 94 that extend completely around the outer diameter of the stripper and slope downwardly toward inner baffles 95 that have a frusto-conical surface which extends to the inner diameter of annular baffles 94. The use of frusto-conical baffles of the types indicated at numbers 94 and 95, are well known to those skilled in the art. The stripping medium that passes upwardly through stripping vessel 92 around baffles 94 and 95 enters the bottom of the stripping vessel through a distributor 96. However, the amount of stripping medium that passes through the stripper vessel through distributor 96 will generally be lower, and often two to three times lower than the amount needed in the previously described stripping vessel 14. The initial stripping of easily removable hydrocarbons in the hydrocarbon rejection zone reduces the total amount of hydrocarbons that must be removed in stripper vessel 92. Therefore, stripper vessel 92 requires a lower overall amount of stripping medium and can operate more efficiently by the prior removal entrained hydrocarbon gases. Catalyst residence time in the stripping zone usually averages less than 60 seconds, but exceeds the catalyst residence time in the hydrocarbon rejection zone. A typical stripper of the type shown in FIG. 1 will require at least 1.5 kg, and on the average more than 2 kg, of steam to approximately every 1000 kg of catalyst that passes through the stripper. A stripping arrangement of the type shown in FIG. 2 will require as little as 0.8 kg of steam per 1000 kg of catalyst that enters the vessel 92. Typically, 75% of the total stripping medium or steam will enter the stripping vessel and 25% will enter the rejection zone. After contact with the stripping medium, coke-containing catalyst is returned from the bottom of stripper vessel 92 to the regenerator vessel via conduit 98. After passing upwardly through all of the baffles 94 and 95, stripping gas is taken by passageway 90 and passes along its upper surface and into the gas collection space under baffle 86.

Figure 3:
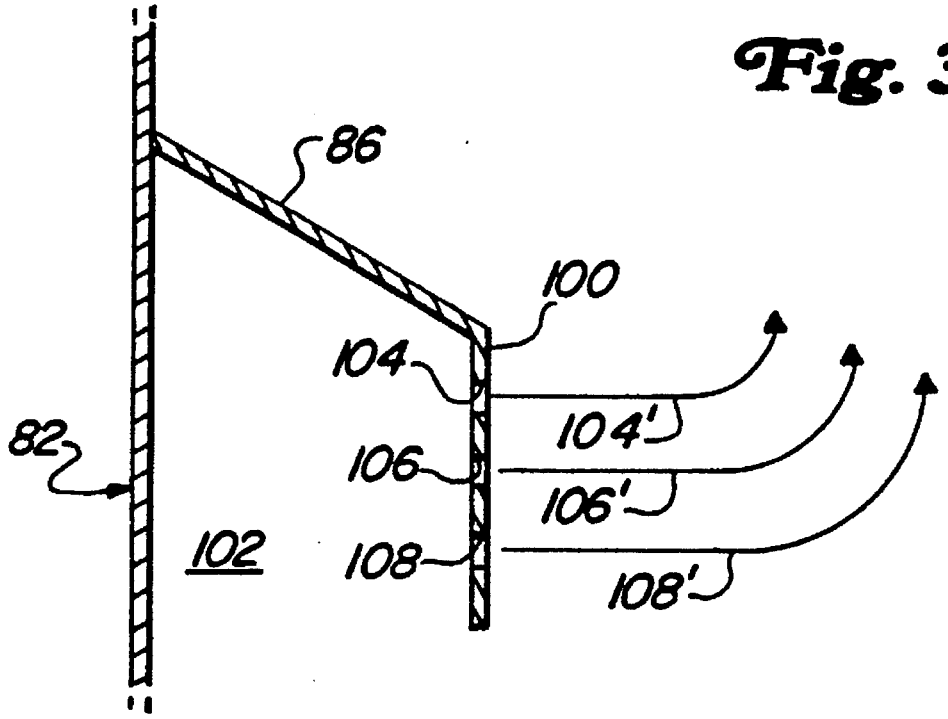
FIG. 3 is an enlarged view of a particular embodiment of this invention showing a baffle located at the inlet to the hydrocarbon rejection zone.

The effectiveness of the stripping gas used in conjunction with either baffle 86 or baffles 94 and 95 can be increased by using a vertical skin and a series of sized holes in each skin that redistribute the stripping gas. An enlarged baffle 86 incorporating a series of redistribution holes is shown in FIG. 3. A vertical skin 100 is shown at the lower edge of baffle 86. Baffle 86, skin 100 and the interior of hydrocarbon rejection zone 82 define a gas collection volume 102. Gas collected in space 102 is redistributed outwardly by holes 104, 106 and 108. The sizes of the holes in skin 100 are varied in order to increase the coverage of stripping gas over the catalyst entering the hydrocarbon rejection zone. Varying the diameter in this manner, creates jets of varying length that redistribute the stripping gas over more of the catalyst stream. As the size of the holes in skin 100 increase, they produce a jet of increasing length. The flow stream associated with each jet is shown by streamline 104', 106' and 108'. Therefore, by increasing the size of the holes with decreasing elevation along the skin, jets of stripping gas having increasing length are formed. Use of variable diameter jets, in this manner, can further reduce the quantity of stripping medium needed to effectively strip hydrocarbons from the catalyst in either the hydrocarbon rejection zone or the stripper vessel.

We claim:

1. A side-by-side fluidized catalytic cracking reactor vessel and stripping vessel arrangement comprising:

a) a vertically oriented reactor vessel having a catalyst inlet;

b) a rejection vessel having a diameter that is less than the diameter of the reactor vessel located subadjacent to and in direct vertical fluid communication with said reactor vessel, said rejection vessel having a length that is less than the diameter of the reactor vessel and defining a rejection zone having a catalyst outlet in the sidewall of a lower section of said rejection vessel and a stripping gas inlet located at or below said catalyst outlet;

c) means for providing a stripping zone including an elongate stripping vessel laterally offset from and located outside of said reactor vessel having a longer vertical length than said rejection vessel;

d) means for passing stripping gas from said stripping zone to an upper section of said rejection zone and for passing catalyst from said catalyst outlet to said stripping zone; and e) a reactor riser in communication with said reactor vessel for discharging catalyst and gas into said reactor vessel.

2. The arrangement of claim 1 wherein at least a portion of said catalyst outlet is located in an upper portion of said lower rejection vessel section.

3. The arrangement of claim 2 wherein said means for passing stripping gas and for passing catalyst includes a passageway having a diameter of at least two feet that at least equals one quarter of the vertical length of the sidewall of said small diameter vessel to provide unobstructed communication between said stripper opening and an upper section of said elongate stripping vessel;

4. The arrangement of claim 1 wherein an annular baffle having a downwardly sloped surface is located in an upper section of said rejection vessel and said baffle has an uppermost end fixed about the inside diameter of said rejection vessel at a location above said catalyst outlet.

5. The arrangement of claim 4 wherein a cylindrical skin extends downwardly from the inner diameter of said baffle and a plurality of holes are spaced circumferentially about said skin at a common elevation.

6. The arrangement of claim 1 wherein said reactor vessel has a cylindrical portion, a cyclone separator is located inside said reactor vessel and said separator has a discharge leg that extends below the cylindrical portion of said vessel.

7. The arrangement of claim 6 wherein said discharge leg extends into said rejection zone.

8. The arrangement of claim 1 wherein said reactor vessel is located directly above a regeneration vessel, a frusto-conical skin supports said reactor from said regenerator and said first stripping zone is located within said skin.

9. A stacked fluidized catalytic cracking reactor and regenerator apparatus having a side-by-side stripper arrangement, said apparatus comprising:

a) a regenerator vessel;

b) a cracking reactor vessel superadjacent to said regenerator vessel;

c) a frusto-conical skirt, fixed to said cracking reactor about the upper end of said frusto-conical skirt and fixed to said regenerator vessel about the lower end of said frusto-conical skirt;

d) a reactor riser, in communication with said regenerator vessel and said cracking reactor vessel for withdrawing catalyst from said regenerator vessel and discharging catalyst and gas into said cracking reactor vessel;

e) a cyclone separator in said cracking reactor vessel having an inlet that receives catalyst and gas from said riser and a discharge leg that discharges catalyst below an upper half of said cracking reactor vessel;

f) a rejection vessel having a diameter and vertical length that is less than the diameter of said cracking reactor vessel subadjacent to and in direct vertical fluid communication with said cracking reactor that defines a rejection zone containing a first stripping zone, said small diameter vessel defining a catalyst outlet in its sidewall, a first stripping gas distributor located below said catalyst outlet, and an annular baffle, said baffle having a downwardly sloped surface and an uppermost end fixed to the inside of rejection vessel above said catalyst outlet;

g) an elongate stripper vessel laterally offset from said cracking reactor vessel and defining a second stripping zone, said elongate stripping vessel having a longer vertical length than said small diameter vessel, a series of downwardly sloped baffles forming a continuous flow path from the top to the bottom of said second stripping zone, a second stripping gas inlet located below said baffles, and at least one catalyst outlet defined by said stripping vessel and located below said baffles;

h) a passageway having a diameter of at least two feet that at least equals one quarter of the vertical length of said small diameter vessel to provide unobstructed communication between said catalyst outlet defined by said rejection vessel and the top of said elongated stripping vessel, said passageway projecting from said stripper opening at an angle no greater than 450° from horizontal; and i) a reactor conduit communicating said at least one catalyst outlet defined by said stripping vessel with said regeneration vessel.

10. The apparatus of claim 9 wherein a cylindrical skirt extends downwardly from the inner diameter of the baffle located in said first stripping zone and a plurality of holes are spaced circumferentially about said skirt at a common elevation.

11. The apparatus of claim 10 wherein said discharge leg extends into said first stripping zone.

* * * * *

UNITED STATES PATENT AND TRADEMARK OFFICE
CERTIFICATE OF CORRECTION

PATENT NO: 5,565,177
DATED: 10/15/96
INVENTORS: ISMAIL B. CETINKAYA

It is certified that error appears in the above-identified patent and that said Letters Patent is hereby corrected as shown below:

In Claim 5, in column 13, at line 36, [skin] should be replaced with skirt, and at line 39 [skin] should also be replaced with skirt.

In Claim 8, in column 13, at lines 48 and 49 [skin] should be replaced with skirt.

In Claim 9(h), in column 14, at line 43, [450°] should be replaced with 45°.

Signed and Sealed this

Seventeenth Day of December, 1996

*Attest:*

Bruce Lehman

BRUCE LEHMAN

*Attesting Officer*

*Commissioner of Patents and Trademarks*